US009592675B2

(12) United States Patent
Matsumoto et al.

(10) Patent No.: US 9,592,675 B2
(45) Date of Patent: Mar. 14, 2017

(54) LIQUID FILL CONTAINER

(71) Applicant: Seiko Epson Corporation, Tokyo (JP)

(72) Inventors: Hitoshi Matsumoto, Matsumoto (JP); Taku Ishizawa, Shiojiri (JP); Mitsuto Yanagisawa, Matsumoto (JP); Yaeko Onishi, Ota-Ku (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/745,226

(22) Filed: Jun. 19, 2015

(65) Prior Publication Data

US 2016/0016408 A1 Jan. 21, 2016

Related U.S. Application Data

(62) Division of application No. 13/297,167, filed on Nov. 15, 2011, now Pat. No. 9,090,075.

(30) Foreign Application Priority Data

Nov. 16, 2010 (JP) ..... 2010-255580

(51) Int. Cl.
*B41J 2/175* (2006.01)

(52) U.S. Cl.
CPC ..... *B41J 2/17506* (2013.01); *B41J 2/17509* (2013.01)

(58) Field of Classification Search
CPC B41J 2/17506; B41J 2/17509; B41J 2/17543; B41J 2/17546
USPC ..... 141/94, 346, 347, 363–366; 347/85–87
See application file for complete search history.

(56) References Cited

U.S. PATENT DOCUMENTS 1,991,225 A * 2/1935 Oslund ..... B65C 9/08 156/476
2,750,068 A 6/1956 Platt, Jr.
3,204,835 A 9/1965 Michel
3,858,739 A 1/1975 Turner et al.
4,408,699 A 10/1983 Stock
(Continued)

FOREIGN PATENT DOCUMENTS

CN 201158474 Y 12/2008
EP 0523915 A2 1/1993
(Continued)

OTHER PUBLICATIONS

Extended European Search Report, dated Feb. 28, 2014, of corresponding EP Application No. 11842320.1.
(Continued)

*Primary Examiner* — Timothy L Maust
(74) *Attorney, Agent, or Firm* — Kilpatrick Townsend & Stockton LLP

(57) ABSTRACT

There is provided a liquid fill container that is used to fill a liquid reservoir supplying a liquid to a liquid ejecting apparatus, with the liquid. The container includes a containing unit that contains the fill liquid; a filling port that is inserted into an inlet of the liquid reservoir, and that allows the liquid contained in the containing unit to flow therethrough to fill the liquid reservoir; and a positioning member that maintains the position of the filling port and the position of the liquid reservoir with respect to each other in the direction in which the filling port is inserted into the liquid reservoir during liquid filling of the liquid reservoir.

13 Claims, 10 Drawing Sheets

(56) References Cited

U.S. PATENT DOCUMENTS

| | | | | |
|---|---|---|---|---|
| 4,512,475 | A | 4/1985 | Federighi | |
| 5,595,223 | A | 1/1997 | Hayao | |
| 5,607,003 | A | 3/1997 | Gray | |
| 5,838,352 | A | 11/1998 | Martinez | |
| 5,883,652 | A | 3/1999 | Moser et al. | |
| 5,897,009 | A | 4/1999 | O'Meara | |
| 5,915,427 | A | 6/1999 | Grabenkort | |
| 5,944,228 | A | 8/1999 | Gray | |
| 5,967,196 | A | 10/1999 | Moser | |
| 6,079,823 | A | 6/2000 | Droege | |
| 6,161,915 | A * | 12/2000 | Bolash | B41J 2/17546 347/19 |
| 6,213,600 | B1 * | 4/2001 | Kobayashi | B41J 2/17503 347/7 |
| 6,585,016 | B1 * | 7/2003 | Falligant | A61M 16/183 128/202.22 |
| 6,678,482 | B2 * | 1/2004 | Masuda | H04N 1/295 399/12 |
| 6,874,665 | B2 | 4/2005 | Doherty et al. | |
| 7,175,264 | B2 | 2/2007 | Qingguo et al. | |
| 7,300,138 | B2 * | 11/2007 | Corner | B41J 2/17513 347/84 |
| 7,360,701 | B2 * | 4/2008 | Sagnak | G06Q 10/06 235/375 |
| 7,537,324 | B2 * | 5/2009 | Yamamoto | B41J 2/17566 347/19 |
| 8,162,456 | B2 * | 4/2012 | Matsuyama | B41J 2/17536 347/86 |
| 8,386,070 | B2 * | 2/2013 | Eliuk | A61J 1/20 141/1 |
| 8,443,853 | B2 | 5/2013 | Sarnoff et al. | |
| 8,579,162 | B2 | 11/2013 | Dyer et al. | |
| 2006/0249948 | A1 * | 11/2006 | Kenney | B42D 15/0093 283/36 |
| 2007/0031619 | A1 * | 2/2007 | Mirabell | A61M 5/178 428/34.1 |
| 2008/0040234 | A1 * | 2/2008 | Rankin | G06Q 30/06 705/26.1 |
| 2008/0187355 | A1 * | 8/2008 | Matsuyama | B41J 2/17559 399/109 |
| 2012/0287209 | A1 | 11/2012 | Van | |

FOREIGN PATENT DOCUMENTS

| | | | |
|---|---|---|---|
| EP | 0523915 | A3 | 1/1993 |
| EP | 2317491 | A1 | 5/2011 |
| JP | 50-132446 | | 11/1973 |
| JP | 61-30622 | U | 2/1986 |
| JP | 7-015559 | U | 3/1995 |
| JP | 09-077081 | A | 3/1997 |
| JP | 2000-085807 | A | 3/2000 |
| JP | 2001-301196 | A | 10/2001 |
| JP | 2002-283582 | A | 10/2002 |
| JP | 2003-054002 | A | 2/2003 |
| JP | 2003-145792 | A | 5/2003 |
| JP | 3099153 | U | 10/2003 |
| JP | 2005-028859 | A | 2/2005 |
| JP | 3111130 | U | 5/2005 |
| JP | 2005-219483 | A | 8/2005 |
| JP | 2006-016011 | A | 10/2006 |
| JP | 3128237 | U | 12/2006 |
| JP | 2007-057636 | A | 3/2007 |
| JP | 2008-183836 | A | 8/2008 |
| JP | 2009-122219 | A | 6/2009 |
| JP | 2010-049105 | A | 3/2010 |
| WO | 93/18920 | A1 | 9/1993 |
| WO | 02/26502 | A1 | 4/2002 |

OTHER PUBLICATIONS

Non-Final Rejection of Jul. 10, 2014 in related U.S. Appl. No. 13/297,167—13 pages.

Final Rejection of Nov. 28, 2014 in related U.S. Appl. No. 13/297,167—15 pages.

Notice of Allowance of Mar. 23, 2015 in related U.S. Appl. No. 13/297,167—10 pages.

* cited by examiner

LIQUID FILL CONTAINER

CROSS REFERENCE TO RELATED APPLICATIONS

This application is a divisional of U.S. application Ser. No. 13/297,167 filed Nov. 15, 2011, which claims priority under 35 U.S.C. §119 to Japanese Patent Application No. 2010-255580 filed Nov. 16, 2010, the entire disclosures of which are expressly incorporated by reference herein.

BACKGROUND

1. Technical Field

The invention relates to liquid fill containers, and particularly to a liquid fill container used to fill a liquid reservoir of an ink jet printer with a liquid such as an ink.

The invention relates to liquid fill containers, and particularly to a liquid fill container used to fill a liquid reservoir of an ink jet printer with a liquid such as an ink.

2. Related Art

An ink jet printer, which is an example of a liquid ejecting apparatus, performs printing by ejecting inks from recording heads onto a print medium (print sheet, for example). Known techniques of supplying inks to recording heads include a technique of supplying inks from ink tanks disposed outside a printer via tubes to recording heads (see JP-A-2005-219483, for example). Each ink tank has an ink inlet, and users can easily perform ink filling through the ink inlet.

With the above-described technique, a user has to keep holding an ink bottle containing a fill ink when filling the ink tank with the fill ink by inserting a filling port of the ink bottle into the inlet of the ink tank. Thus, this technique is disadvantageous because the position of the filling port of the ink bottle is not fixed.

With this technique, the filling port of the ink bottle may be inserted into the ink tank down to a point deeper than expected, leading to improper ink filling.

With this technique, a tip portion of the ink bottle, including the filling port, may become stained with the ink contained in the ink tank.

A label indicating information required for filling the ink tank may be affixed to an ink bottle of the above type. In such a case, if a leaking ink or the like adheres to the label, a user may be unable to read the information required for filling the ink tank.

These are problems not exclusive to an ink bottle that is used to fill an ink tank with an ink, but common to liquid fill containers that are used to fill, with liquids, liquid reservoirs that supply the liquids to liquid ejecting apparatuses.

SUMMARY

An advantage of some aspects of the invention is that a liquid fill container is provided, that is used to fill, with a liquid, a liquid reservoir that supplies the liquid to a liquid ejecting apparatus, and that facilitates liquid filling of the liquid reservoir.

Some aspects of the invention will be described below.

According to a first aspect of the invention, a liquid fill container used to fill, with a liquid, a liquid reservoir supplying the liquid to a liquid ejecting apparatus is provided. The liquid fill container includes a containing unit that contains the liquid with which the liquid reservoir is to be filled; a filling port that is inserted into an inlet of the liquid reservoir and that allows the liquid contained in the containing unit to flow therethrough to fill the liquid reservoir; and a positioning member that maintains the position of the filling port and the position of the liquid reservoir with respect to each other in the direction in which the filling port is inserted into the liquid reservoir during liquid filling of the liquid reservoir.

According to the liquid fill container described in the first aspect, during liquid filling of the liquid reservoir, the position of the filling port of the liquid fill container and the position of the liquid reservoir are maintained with respect to each other in the direction in which the filling port is inserted. Thus, the position of the filling port is fixed with respect to the position of the liquid reservoir.

In the liquid fill container according to the first aspect, it is preferable that the positioning member be disposed so as to maintain the positions of the filling port and the liquid reservoir with respect to each other in such a manner that the filling port is kept from contacting the liquid in the liquid reservoir after the liquid reservoir is filled with the liquid up to an upper limit of the amount of the liquid containable in the liquid reservoir.

With the above liquid fill container, the filling port is kept from contacting the liquid even after the liquid reservoir is filled with the liquid up to an upper limit of the amount of the liquid containable in the liquid reservoir. Thus, an appropriate amount of liquid can be supplied for filling the liquid reservoir. In addition, the filling port and the vicinity thereof of the liquid fill container can be prevented from being stained with the liquid.

The liquid fill container according to the first aspect may further include a liquid guide portion that guides the liquid in the containing unit to the filling port during liquid filling of the liquid reservoir, the liquid guide portion having a cross section smaller than a cross section of the containing unit. The positioning member may be a protrusion that protrudes outward from an outer wall of the liquid guide portion, and that maintains the positions of the filling port and the liquid reservoir with respect to each other by contacting an end portion of the inlet of the liquid reservoir during liquid filling, the end portion being open to the outside.

With the above liquid fill container, the position of the filling port with respect to the position of the liquid reservoir can be maintained during liquid filling, using the protrusion provided on an outer wall of the liquid guide portion that guides the liquid to the filling port from the containing unit.

In the liquid fill container according to the first aspect, it is preferable that a plurality of the protrusions be disposed at equal intervals in the circumferential direction of the liquid guide portion.

With the above liquid fill container, the position of the filling port can be maintained during liquid filling by use of the plurality of protrusions disposed at equal intervals in the circumferential direction of the liquid guide portion. This allows the filling port to be positioned further stably.

The liquid fill container according to the first aspect may further include a stopper member. The filling port may be formed by removing the stopper member with a shearing force being applied to the stopper member. The stopper member may have a recessed portion that allows the removed stopper member to be used to cap the filling port.

With the above liquid fill container, the filling port formed by removing the stopper member can be capped with the stopper member with the presence of the recessed portion of the stopper member.

According to a second aspect of the invention, a liquid fill container used to fill, with a liquid, a liquid reservoir supplying the liquid to a liquid ejecting apparatus is provided. The liquid fill container includes a containing unit that contains the fill liquid; and a filling port that is inserted into an inlet of the liquid reservoir and that allows the liquid contained in the containing unit to flow therethrough to fill the liquid reservoir. A label indicating ID information used for filling the liquid reservoir with the liquid is affixed to the liquid fill container. A surface of the label is liquid-repellent.

With the liquid fill container described in the second aspect, a leaking ink is less likely to keep adhering to the surface of the label indicating ID information used for liquid filling.

According to a third aspect of the invention, a liquid fill container used to fill, with a liquid, a liquid reservoir supplying the liquid to a liquid ejecting apparatus is provided. The liquid fill container includes a bottom portion; a containing unit that contains the fill liquid; and a filling port that is inserted into an inlet of the liquid reservoir and that allows the liquid contained in the containing unit to flow therethrough to fill the liquid reservoir. A first label and a second label different from the first label are affixed to the liquid fill container, and the second label indicates ID information used for filling the liquid reservoir with the liquid. In a state where the liquid fill container is placed on a horizontal surface with the bottom portion contacting the horizontal surface, the first label and the second label are affixed to the liquid fill container in such a manner that an upper end portion, in the vertical direction, of the second label overlaps a lower end portion, in the vertical direction, of the first label.

With the liquid fill container described in the third aspect, a leaking ink flowing through a gap between the first label and the outer wall of the liquid fill container is prevented from adhering to the surface of the second label.

The invention can be embodied in various modes. Aspects of the invention, such as a liquid filling method by use of the above-described liquid fill container, can be embodied in addition to the liquid fill container described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described in the order of A. Embodiment and B. Modifications.

A. Embodiment

A-1. Configuration of Liquid Ejecting System

Figure 1A:
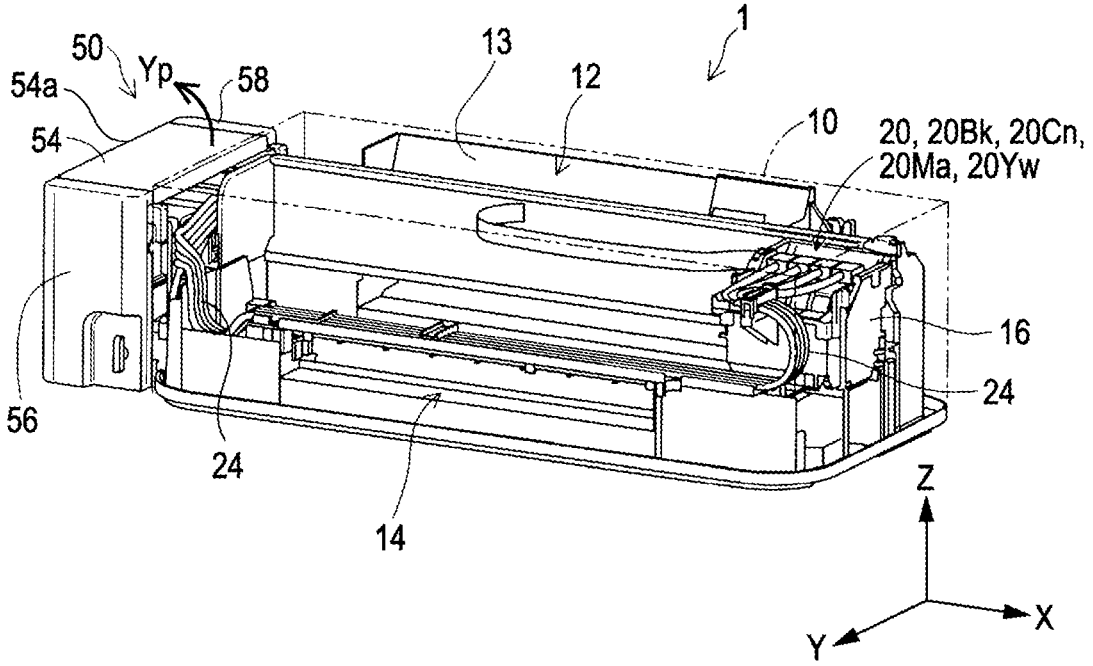
FIGS. 1A and 1B illustrate a liquid ejecting apparatus and an ink tank that serves as a liquid reservoir for supplying a liquid to the liquid ejecting apparatus.
Figure 1B:
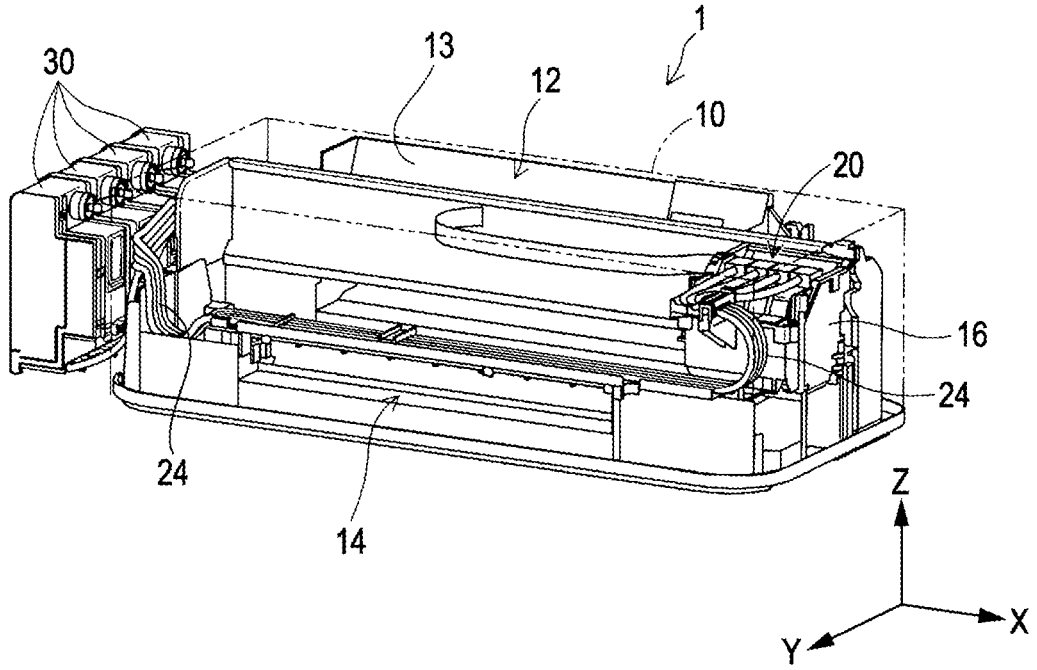

FIG. 1 illustrates a liquid ejecting system 1 that is closely related to an ink bottle 70 to be described later and that includes an ink jet printer 12 and ink tanks 30. FIG. 1A is a first external perspective view of the liquid ejecting system 1. FIG. 1B is a second external perspective view of the liquid ejecting system 1, including an illustration of the ink tanks 30. FIGS. 1A and 1B each illustrate X-, Y-, and Z-axes that are perpendicular to one another, for specifying directions. As needed, some of the other drawings also illustrate X-, Y-, and Z-axes that are perpendicular to one another.

As illustrated in FIG. 1A, the liquid ejecting system 1 includes an ink jet printer 12 (or simply a "printer 12"), which serves as a liquid ejecting apparatus, and a tank unit 50. The printer 12 includes a paper feed unit 13, a paper output unit 14, a carriage (subtank installation unit) 16, and four subtanks 20. The four subtanks 20 contain inks having different colors. Specifically, the four subtanks 20 are a subtank 20Bk containing a black ink, a subtank 20Cn containing a cyan ink, a subtank 20Ma containing a magenta ink, and a subtank 20Yw containing a yellow ink. The four subtanks 20 are installed in the carriage 16.

Print sheets loaded on the paper feed unit 13 are transported into the printer 12. After being subjected to printing, the print sheets are output from the paper output unit 14.

The carriage 16 is movable in a main scanning direction (a paper width direction, or the X-axis direction). The carriage 16 is moved by driving a stepping motor (not illustrated) and via a timing belt (not illustrated). Recording heads 17 (see FIG. 2) are provided on the undersurface of the carriage 16. Printing is performed by ejecting the inks onto a print sheet through multiple nozzles of the recording heads 17. The components of the printer 12, including the timing belt and the carriage 16, are housed and protected in a casing 10.

The tank unit 50 includes a top panel 54, a first side panel 56, a second side panel 58, and a bottom panel (not illustrated). The panels 54, 56, and 58 and the bottom panel may be made of a synthetic resin such as polypropylene (PP) or polystyrene (PS). In the embodiment, the panels 54, 56, and 58 and the bottom panel are made of polystyrene. As illustrated in FIG. 1B, the tank unit 50 further includes the four ink tanks 30, which serve as liquid reservoirs, enclosed by the panels 54, 56, and 58 and the bottom panel. The panels 54, 56, and 58 and the bottom panel allow the tank unit 50 to be placed more stably on a predetermined position (on a horizontal surface of a desk or a shelf, for example). As illustrated in FIG. 1A, the top panel 54 is pivotally openable around a side 54*a* in the arrow Yp direction.

The four ink tanks 30 contain inks of colors corresponding to those contained in the four subtanks 20. Specifically, the four ink tanks 30 contain the black ink, the cyan ink, the magenta ink, and the yellow ink. The ink tanks 30 can contain larger amounts of inks than the subtanks 20.

The ink tanks 30 containing inks of the corresponding colors are connected via hoses (tubes) 24 to the corresponding subtanks 20 for containing the inks of the corresponding colors. The hoses 24 are made of a flexible material such as a synthetic rubber. When an ink is ejected through one recording head 17 and thus the ink in the corresponding subtank 20 is consumed, the ink in the corresponding ink tank 30 is supplied to the subtank 20 through the corresponding hose 24. Thus, the liquid ejecting system 1 can continue printing for hours without interruption. Instead of providing the subtanks 20, inks may be directly supplied from the ink tanks 30 to the recording heads 17 via the hoses 24.

Figure 2:
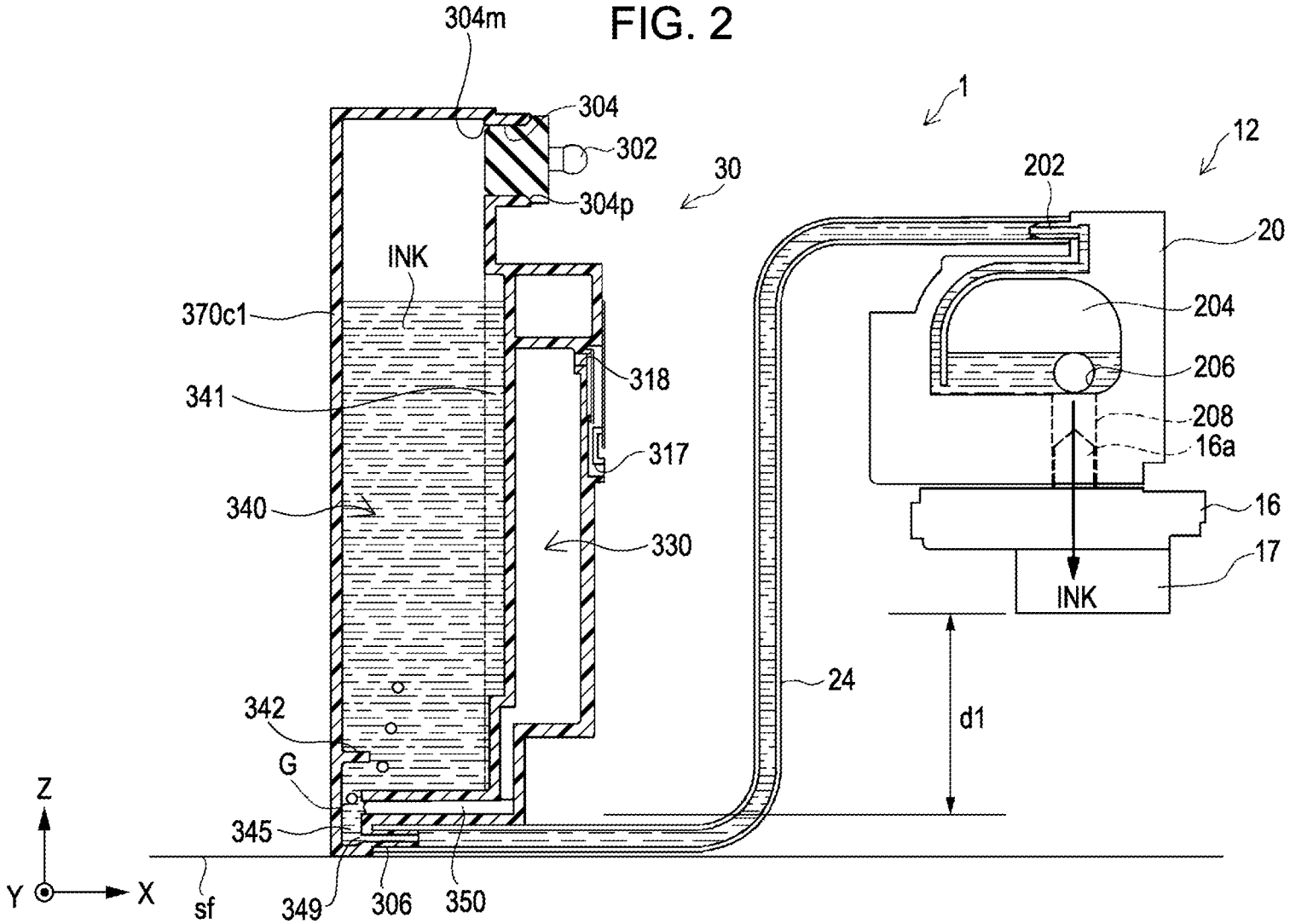
FIG. 2 illustrates how a liquid is supplied from an ink tank to a sub tank.

Referring to FIG. 2, the principle based on which inks are supplied from the ink tanks 30 to the subtanks 20, and the schematic configurations of one ink tank 30 and one subtank 20 are described. FIG. 2 is a schematic sectional view illustrating how a liquid is supplied from the ink tank 30 to the subtank 20.

The liquid ejecting system 1 is placed on a predetermined installation surface sf that is a horizontal surface. The ink tank 30 includes a liquid discharge portion 306, a liquid-containing chamber 340, an air-containing chamber 330, a liquid inlet 304, an ink-tank plug member 302, an air intake 317, and an air vent 318.

When the ink tank 30 is in a use position so that the ink is supplied from the ink tank 30 to the subtank 20, a positive Z-axis direction coincides with the vertical upward direction, and a negative Z-axis direction coincides with the vertical downward direction. On the other hand, when the ink tank 30 is in an injection position so that the ink is injected into the ink tank 30, a positive X-axis direction coincides with the vertical upward direction and a negative X-axis direction coincides with the vertical downward direction. When an ink is to be injected into one of the ink tanks 30 disposed (arranged side by side) in the tank unit 50, all the ink tanks 30 take the injection position since the position of the entire tank unit 50 changes. Before the inks are injected into the ink tanks 30, a user opens the top panel 54 (see FIG. 1A).

The liquid-containing chamber 340 contains an ink. The liquid-containing chamber 340 has a partition wall 342 extending at a predetermined length from the inner surface of a first wall 370*c*1 toward the inner side of the liquid-containing chamber 340. The partition wall 342 is formed inside the liquid-containing chamber 340 across the chamber 340 in the Y-axis direction (width direction). In other words, the partition wall 342 divides the first wall 370*c*1 into two regions. One of the two divided regions that is continuous with the liquid discharge portion 306 is referred to as a liquid holding portion 345. The liquid-containing chamber 340 also has a spacer portion 341. The spacer portion 341 is defined by walls of the liquid-containing chamber 340 and formed into a recessed shape. When the ink tank 30 is in the injection position, the liquid inlet 304 opens downward in the vertical direction (negative X-axis direction). In addition, when the ink tank 30 is in the injection position, the spacer portion 341 is positioned higher (in the positive X-axis direction) than a lower end portion 304*m* of the liquid inlet 304. For ease of understanding, the boundary between the spacer portion 341 and the remaining region in the liquid-containing chamber 340 is represented by a broken line.

The liquid inlet 304 has a round passage inside and communicates with the liquid-containing chamber 340. To be more specific, an upper end portion 304*p*, which is one of the end portions of the liquid inlet 304, is open to the outside, while the lower end portion 304*m*, which is the other end portion, is open to the inside of the liquid-containing chamber 340. The ink-tank plug member 302 is removably fitted into the liquid inlet 304 to prevent the ink from leaking out from the liquid inlet 304. When the ink tank 30 is in the use position, the liquid inlet 304 is open in a direction (horizontal direction, or the positive X-axis direction in FIG. 2) perpendicular to the vertical direction (Z-axis direction).

A liquid outlet portion 349, which is one of the end portions of the liquid discharge portion 306, is continuous with the liquid-containing chamber 340. In other words, the liquid outlet portion 349 is open to the inside of the liquid-containing chamber 340. When the ink tank 30 is in the injection position, the liquid outlet portion 349 is positioned lower (in the negative X-axis direction) than the spacer portion 341. The liquid discharge portion 306 of the ink tank 30 is connected to a liquid receiving portion 202 of the subtank 20 via the hose 24. Thus, the ink in the liquid-containing chamber 340 flows from the liquid discharge portion 306 to the subtank 20 through the hose 24.

The air intake 317 and the air vent 318 serve as two end portions of a meandering passage for introducing air from the outside into the ink tank 30. The air vent 318 communicates with the air-containing chamber 330. The air-containing chamber 330 communicates with the liquid-containing chamber 340 via a communication portion 350, which is a narrow passage. The communication portion 350 is a passage having a passage area small enough to allow formation of a meniscus. When the ink tank 30 is in the use state in which the ink tank 30 supplies the ink to the printer 12, a meniscus is formed in the communication portion 350.

The air-containing chamber 330 has a predetermined capacity. When the air in the liquid-containing chamber 340 expands due to a change in temperature or the like and causes the ink to flow in a reverse direction into the air-containing chamber 330 through the communication portion 350, the air-containing chamber 330 can store a predetermined amount of ink. In other words, since the ink tank 30 includes the air-containing chamber 330, the ink is less likely to flow out from the air intake 317 even if the ink flows in a reverse direction.

A case is considered where an ink is injected from the liquid inlet 304 into the liquid-containing chamber 340 in the injection position, the liquid inlet 304 is then plugged with the ink-tank plug member 302, and then the ink tank 30 is changed to the use position. In this case, the air in the liquid-containing chamber 340 expands and thus the liquid-containing chamber 340 is kept at a negative pressure. On the other hand, the air-containing chamber 330 is kept at atmospheric pressure since the air-containing chamber 330 communicates with the air vent 318.

The subtank 20 is made of a synthetic resin such as polystyrene or polyethylene. The subtank 20 includes an ink storage chamber 204, an ink flow channel 208, and a filter 206. An ink supply needle 16*a* of the carriage 16 is inserted into the ink flow channel 208. The filter 206 catches impurities including foreign substances that would be included in an ink, to prevent the impurities from flowing to the recording head 17. By being sucked by the recording head 17, the ink in the ink storage chamber 204 flows through the ink flow channel 208 and the ink supply needle 16*a* and is then supplied to the recording head 17. The ink supplied to the recording head 17 is ejected through the nozzle to the outside (print sheet).

In the use position, the communication portion 350 in which a meniscus is formed is positioned lower than the recording head 17. This positioning causes a hydraulic head difference d1. The hydraulic head difference d1 occurring while a meniscus is formed in the communication portion 350 in the use position is also referred to as a "normal hydraulic head difference d1."

When the ink in the ink storage chamber 204 is sucked by the recording head 17, the pressure of the ink storage chamber 204 becomes a predetermined negative pressure or higher. When the ink storage chamber 204 is at a predetermined negative pressure or higher, the ink in the liquid-containing chamber 340 is supplied to the ink storage chamber 204 via the hose 24. In other words, the amount of ink equivalent to that having flowed to the recording head 17 is automatically supplied from the liquid-containing chamber 340 to fill the ink storage chamber 204. More specifically, the ink is supplied from the liquid-containing chamber 340 to the ink storage chamber 204 when the suction force (negative pressure) of the printer 12 becomes larger than the hydraulic head pressure d1 by a certain amount. The hydraulic head pressure d1 occurs due to the difference in vertical height between the level of the recording head 17 (or nozzle, more precisely) and the liquid level of the ink contacting the air-containing chamber 330 in the ink tank 30.

As the ink in the liquid-containing chamber 340 is consumed, air G (or a "bubble G") in the air-containing chamber 330 is introduced into the liquid-containing chamber 340 through the communication portion 350. Thus, the liquid level of the liquid-containing chamber 340 is lowered.

A-2. Configuration of Ink Tank

Figure 3:
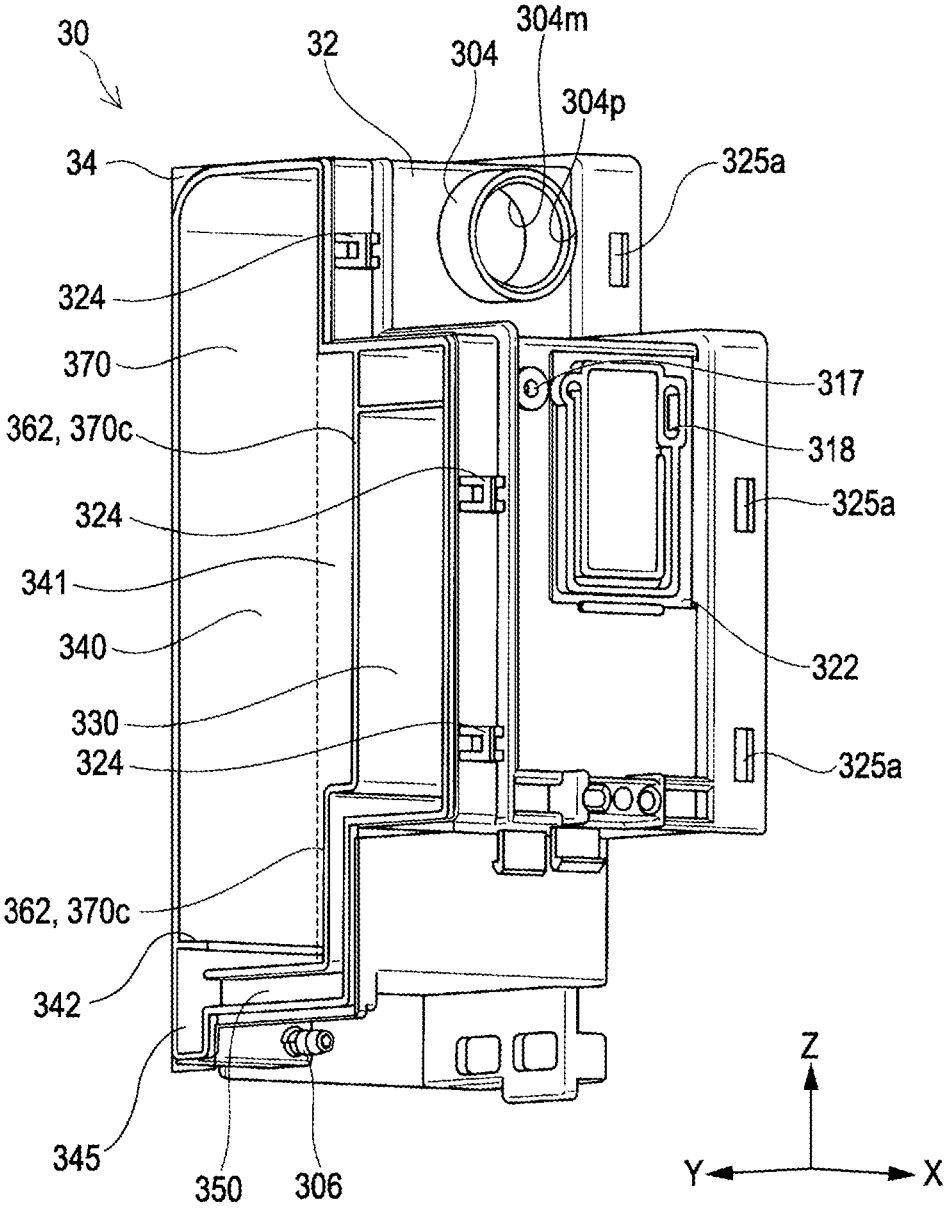
FIG. 3 is an external perspective view of an ink tank.
Figure 4:
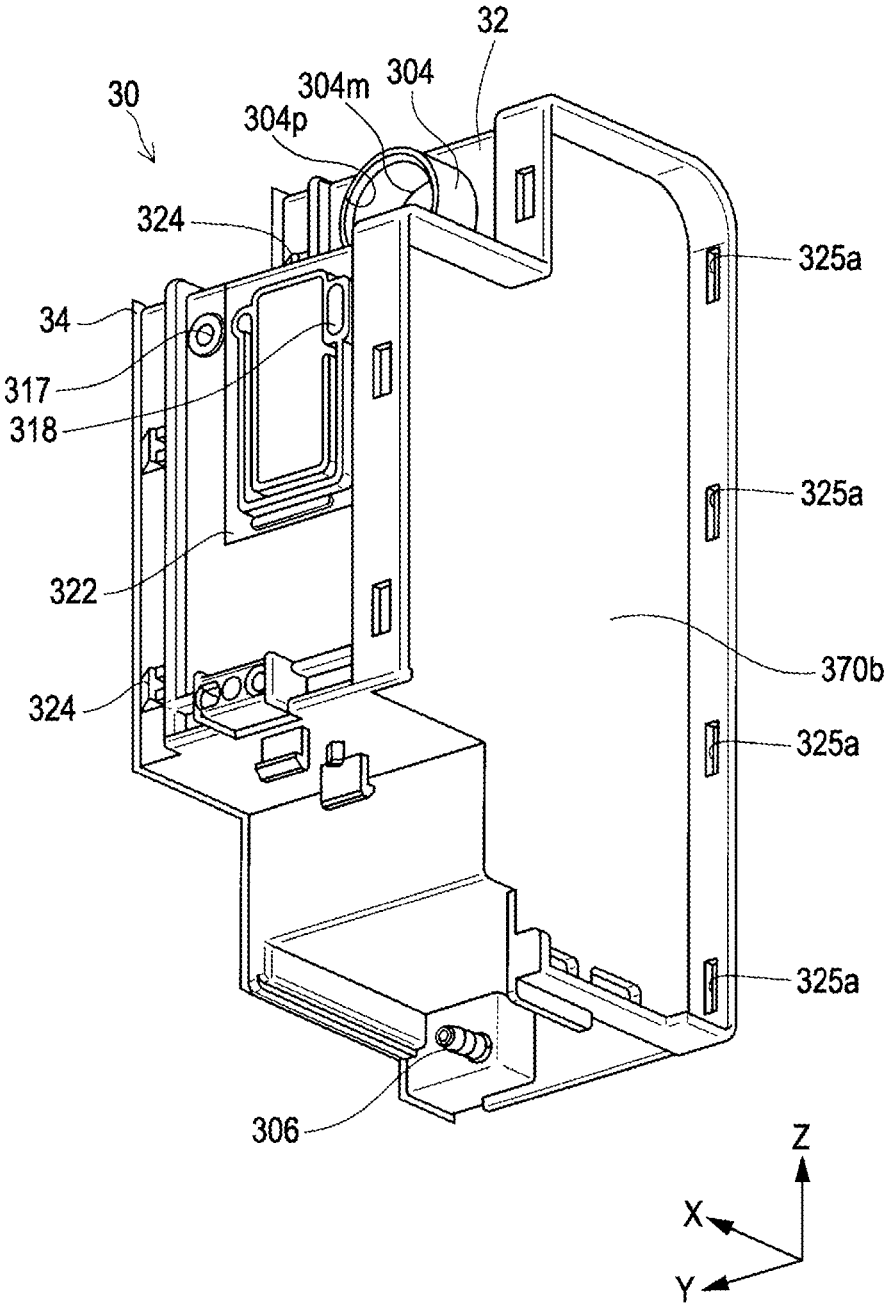
FIG. 4 is an external perspective view of an ink tank.
Figure 5:
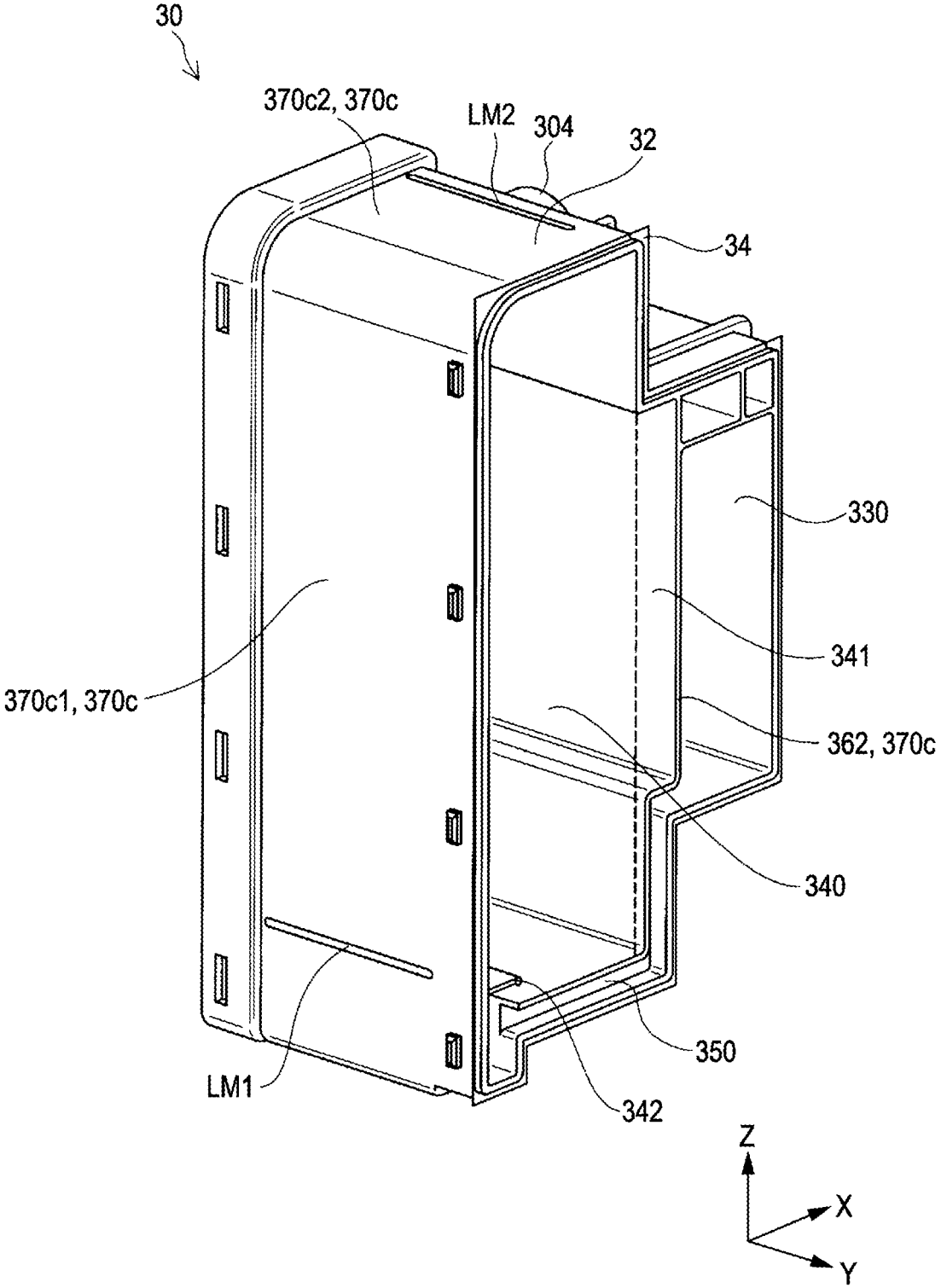
FIG. 5 is an external perspective view of an ink tank.

Referring now to FIGS. 3 to 5, a configuration of the ink tank 30 will be described. FIG. 3 is a first external perspective view of the ink tank 30. FIG. 4 is a second external perspective view of the ink tank 30. FIG. 5 is a third external perspective view of the ink tank 30. Note that the illustration of the ink-tank plug member 302 (FIG. 2) is omitted in FIGS. 3 to 5.

As illustrated in FIGS. 3 to 5, the ink tank 30 has a generally pillar-like shape (specifically, a generally prism-like shape). As illustrated in FIG. 3, the ink tank 30 includes a tank body 32, a first film 34, and a second film 322.

The tank body 32 is made of a synthetic resin such as polypropylene. The tank body 32 is semitransparent. Thus, users can externally recognize the amount of ink in the tank body 32. The tank body 32 is in a recessed shape with one side surface being open. Ribs (walls) 362 of various shapes are formed in a recessed portion of the tank body 32. Here, the open side surface (the side surface forming an opening and including the outer frame of the tank body 32) is referred to as an open wall 370.

The first film 34 is made of a synthetic resin such as polypropylene and is transparent. The first film 34 is attached to the tank body 32 by thermal bonding in such a manner as to cover the opening of the open wall 370. More specifically, the first film 34 is tightly attached to the end faces of the ribs 362 and to the end face of the outer frame of the tank body 32 so that no gap is formed therebetween. As a result of this attachment, multiple chambers are formed.

Specifically, the air-containing chamber 330, the liquid-containing chamber 340, and the communication portion 350 are formed as main chambers. In other words, the tank body 32 and the first film 34 cooperatively define the air-containing chamber 330, the liquid-containing chamber 340, and the communication portion 350. Note that thermal bonding is not the only means of attaching the first film 34 to the tank body 32, and an adhesive agent, for example, may be used for attachment.

The liquid-containing chamber 340 is formed by multiple walls. Specifically, an open wall 370 is formed by the first film 34, an opposite wall 370*b* (FIG. 4) that is opposite the open wall 370 across an inner space (the liquid-containing chamber 340, for example), and multiple joint walls 370*c* (FIGS. 3 and 5) joined to the open wall 370 and the opposite wall 370*b*. As illustrated in FIGS. 3 and 4, the open wall 370 and the opposite wall 370*b* have the same shape (a protruding shape).

As illustrated in FIG. 5, the multiple joint walls 370*c* include the first wall 370*c*1 and a second wall 370*c*2. The first wall 370*c*1 is externally recognizable when the ink tanks 30 are assembled into the tank unit 50 (as in FIG. 1A). Among the multiple walls defining the liquid-containing chamber 340, the open wall 370 (FIG. 3) and the opposite wall 370*b* (FIG. 4) are not externally recognizable when the ink tanks 30 are assembled into the tank unit 50, because the walls 370 and 370*b* have flat surfaces perpendicular to the direction in which the multiple ink tanks 30 are disposed (direction in which the ink tanks 30 are arranged side by side, or the Y-axis direction).

When the ink tank 30 is in the use position, the first wall 370*c*1 is oriented upright on an installation surface (horizontal surface) on which the ink tank 30 is provided. In other words, the first wall 370*c*1 extends vertically when the ink tank 30 is in the use position. In the embodiment, the first wall 370*c*1 serves as a wall of the ink tank 30 and forms an almost right angle with the installation surface (horizontal surface) when the ink tank 30 is in the use position. When the ink tank 30 is in the injection position, the first wall 370*c*1 serves as a bottom surface of the ink tank 30.

When the ink tank 30 is in the injection position, the second wall 370*c*2 is oriented upright on an installation surface (horizontal surface) on which the ink tank 30 is provided. In other words, the second wall 370*c*2 extends vertically when the ink tank 30 is in the injection position. In the embodiment, the second wall 370*c*2 serves as a wall of the ink tank 30 and forms an almost right angle with the installation surface (horizontal surface) when the ink tank 30 is in the injection position.

As illustrated in FIG. 5, the first wall 370*c*1 has a lower limit line LM1 serving as a lower limit portion. The second wall 370*c*2 has an upper limit line LM2 serving as an upper limit portion. The lower limit line LM1 and the upper limit line LM2 are straight lines. The lower limit line LM1 is a horizontal (perpendicular to the vertical direction) line in the use position. The upper limit line LM2 is a horizontal (perpendicular to the vertical direction) line in the injection position. The lower limit line LM1 and the upper limit line LM2 are in forms of ridges protruding from the outer surfaces of the first wall 370*c*1 and the second wall 370*c*2, and are formed integrally with the tank body 32.

When the ink tank 30 is in the use position, the lower limit line LM1 notifies users that, resulting from consumption of the ink in the liquid-containing chamber 340, the amount of the ink has reached a first threshold that is a lower limit at which the liquid ejecting system 1 can guarantee appropriate ejection. When the ink tank 30 is in the injection position, the upper limit line LM2 notifies users that, resulting from the injection of the ink into the liquid-containing chamber 340 through the liquid inlet 304 from the ink bottle 70, the amount of ink in the liquid-containing chamber 340 has reached a second threshold that is an upper limit of the amount of ink containable in the ink tank 30. The ink bottle 70 that serves as an ink fill container will be described later. In short, the lower limit line LM1 and the upper limit line LM2 are used by users to externally recognize that the amount of liquid (ink) in the liquid-containing chamber 340 has reached the first and second thresholds, respectively.

A-3. Configuration of Ink Bottle

Figure 6:
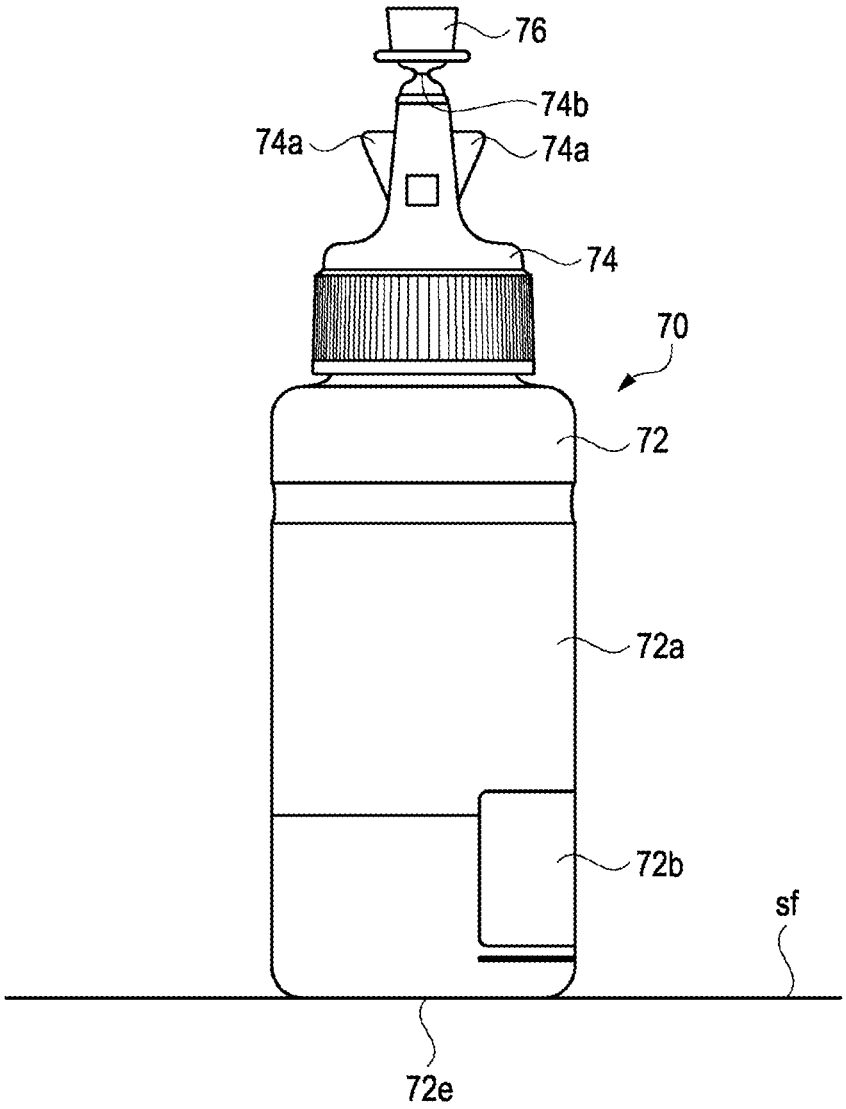
FIG. 6 is a front view of an ink bottle, which serves as a liquid fill container, placed on a horizontal surface.

FIG. 6 illustrates the ink bottle 70, which is an example of the liquid fill container according to an aspect of the invention. The ink bottle 70 is used to fill each ink tank 30 of the liquid ejecting system 1 with an ink. The ink bottle 70 includes a body unit 72, a cap unit 74, and an ink-bottle stopper 76. The body unit 72 contains an ink with which the ink tank 30 is filled. The cap unit 74 has an ink filling port 74*b* that serves as a filling port through which the ink flows to fill the ink tank 30. The cap unit 74 is coupled with the body unit 72. Before the ink bottle 70 is used, the ink-bottle stopper 76 is joined to the cap unit 74 at the ink filling port 74*b* of the cap unit 74. The ink bottle 70 can be made of a synthetic resin such as polyethylene, polypropylene, or polystyrene.

The body unit 72 is in a generally cylindrical shape. During storage or the like, the ink bottle 70 is placed on a flat surface of a desk or a shelf, with a bottom portion 72*e* contacting the flat surface. A first label 72*a* is affixed to an outer wall of the body unit 72 and a second label 72*b* is affixed to the body unit 72 at a portion closer to the bottom portion 72*e* than the first label 72*a* is. The first label 72*a* indicates, for example, a product name of the ink bottle 70, serving as an ink fill container for the ink tank 30 of the liquid ejecting system 1, and a pattern representing an image of the product.

Figure 10:
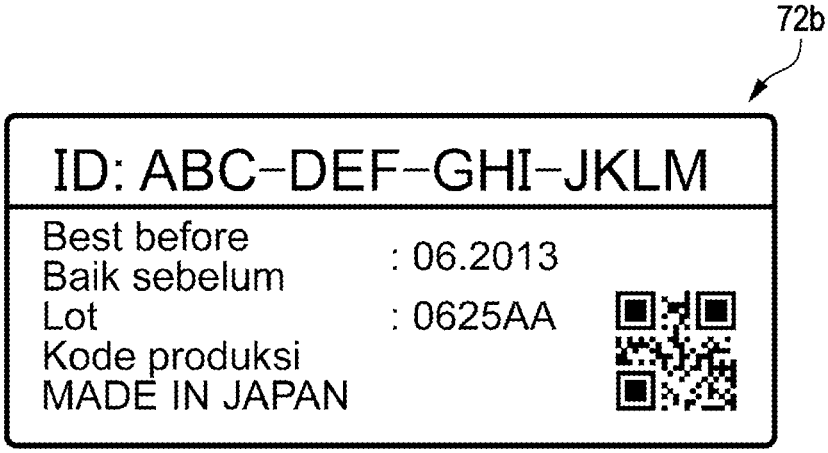
FIG. 10 illustrates a label affixed to an ink bottle.

On the other hand, the second label 72*b* indicates, for example, ID information required for filling the ink tank 30 of the liquid ejecting system 1 with the ink contained in the ink bottle 70, and information on the expiration date of the ink (see FIG. 10). The second label 72*b* is preferably made of a coated paper or formed of a label having a liquid-repellent surface. Examples of labels having this property include DURATACK (registered trademark) 10PN produced by Nitto Denko Corporation. As long as the second label 72*b* has a liquid-repellent surface, the leaking ink or the like is less likely to keep adhering to the surface of the second label 72*b*.

As illustrated in FIG. 6, the first label 72*a* and the second label 72*b* are affixed to the ink bottle 70 in such a manner that an upper end portion of the second label 72*b* overlaps a lower end portion of the first label 72*a* when the ink bottle 70 is placed on the predetermined installation surface sf that is a horizontal surface, with the bottom portion 72*e* contacting the installation surface sf. With this configuration, the ink having leaked from the ink filling port 74*b* and having flowed down through a gap between the outer wall of the body unit 72 and the adhesive surface of the first label 72*a* is prevented from adhering to the surface of the second label 72*b*. Consequently, it becomes less likely that users are unable to read ID information or the expiration date information indicated on the surface of the second label 72*b*.

Figure 7:
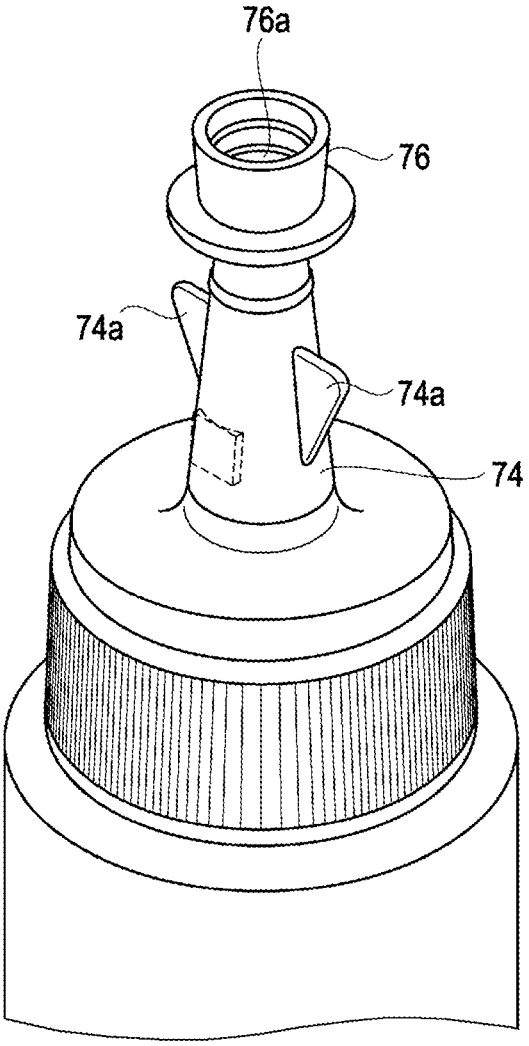
FIG. 7 is an external perspective view of a cap unit coupled to a body unit of an ink bottle.
Figure 8:
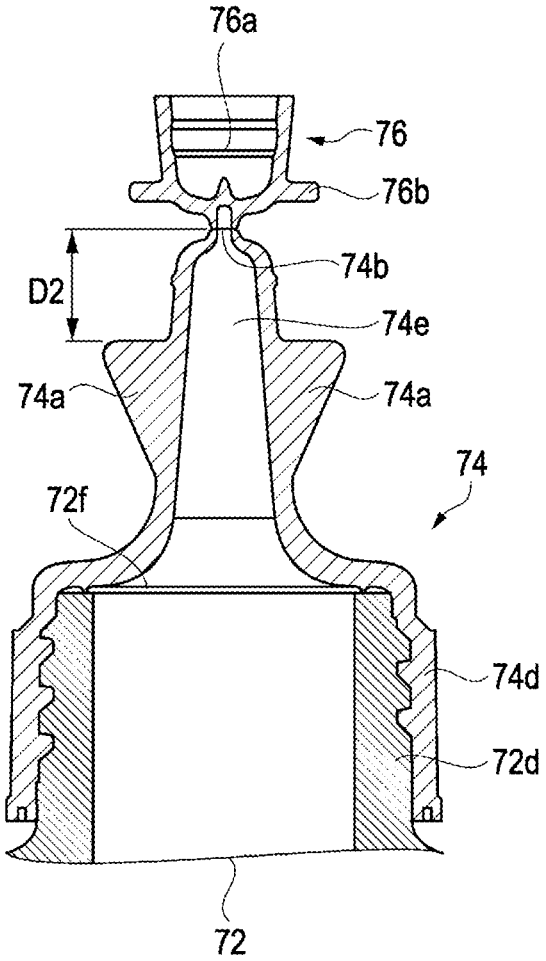
FIG. 8 is a sectional view of a cap unit coupled to a body unit of an ink bottle.

FIG. 7 is an external perspective view of the cap unit 74 coupled to the body unit 72 of the ink bottle 70, and the ink-bottle stopper 76 joined to the cap unit 74. FIG. 8 is a sectional view of the cap unit 74 coupled to the body unit 72. As illustrated in FIG. 8, the body unit 72 and the cap unit 74 are coupled to each other by coupling a coupling portion 72*d* of the body unit 72 and a coupling portion 74*d* of the cap unit 74 with each other. The coupling portions 72*d* and 74*d* each have a helical projection and a helical depression. Coupling between the body unit 72 and the cap unit 74 is released by twisting the cap unit 74 off the body unit 72.

Before use, the opening of the body unit 72 opposite to the bottom portion 72*e* is sealed by a film 72*f* that is an aluminum evaporated film or the like. Before filling the ink tank 30 with an ink, the user removes the cap unit 74 from the body unit 72 and peels off the film 72*f*.

As illustrated in FIG. 8, before the ink bottle 70 is opened (before use), the cap unit 74 and the ink-bottle stopper 76 are joined to each other by being integrally molded out of a synthetic resin. The ink filling port 74*b* is formed and the ink bottle 70 is opened by user's operations, such as, by pulling the ink-bottle stopper 76 apart from the cap unit 74. In other words, when the ink bottle 70 is opened, a shearing force is applied to a portion of the cap unit 74, which is to become the ink filling port 74*b*, and thus the cap unit 74 and the ink-bottle stopper 76 become separated from each other and form the ink filling port 74*b*. Consequently, an ink can flow out of the ink filling port 74*b* to fill the ink tank 30.

The cap unit 74 has an ink guide portion 74*e* (liquid guide portion) that guides the ink contained in the body unit 72 to the ink filling port 74*b* during ink filling of the ink tank 30. The cross section of the ink guide portion 74*e* is smaller than the cross section of the body unit 72.

As illustrated in FIGS. 7 and 8, two protrusions (positioning members) 74*a* protrude outward from the outer wall of the cap unit 74 (ink guide portion 74*e*), and are disposed at a predetermined distance (D2) from the ink filling port 74*b*. These two protrusions 74*a* are disposed to form an angle of 180° with respect to each other in plan view. In other words, the two protrusions 74*a* are arranged at equal intervals in the circumferential direction of the ink guide portion 74*e*.

The ink-bottle stopper 76 has a recessed portion 76*a* on the side opposite to the side to which the cap unit 74 is joined. The recessed portion 76*a* allows the ink-bottle stopper 76 to be used as a cap for protecting the ink filling port 74*b* after the cap unit 74 is opened. The ink-bottle stopper 76 also has a finger tab 76*b*. A user can easily remove the ink-bottle stopper 76 by hooking his/her fingers on the finger tab 76*b* when the recessed portion 76*a* is used to cap the ink filling port 74*b*.

A-4. How to Fill Ink Tank with Ink

For filling the ink tank 30 with an ink, a user is prompted to enter ID information via a user interface (not illustrated) of the printer 12 or via a printer driver screen (not illustrated) displayed on a display of a host personal computer (not illustrated) connected to the printer 12.

The reason why a user is required to enter such ID information for filling the ink tank 30 with the ink supplied from the ink bottle 70 is to guarantee proper filling with the appropriate type of ink (ink color, pigment-base ink, or dye-base ink) for the printer 12. Another reason is to appropriately manage the amount of ink in the ink tank 30. Thus, when the user enters appropriate ID information, the ink tank 30 is allowed to be filled with an ink.

The position of the ink tank 30 is changed from the use position (see FIG. 1B) to the injection position by tilting the ink tank 30 so that the first wall 370*c*1 faces the installation surface of a desk, a shelf, or the like. Then, the ink-tank plug member 302 that blocks up the liquid inlet 304 is removed to open the liquid inlet 304. Thereafter, the ink filling port 74*b* of the ink bottle 70 is inserted into the liquid inlet 304 of the ink tank 30 for ink filling.

Figure 9A:
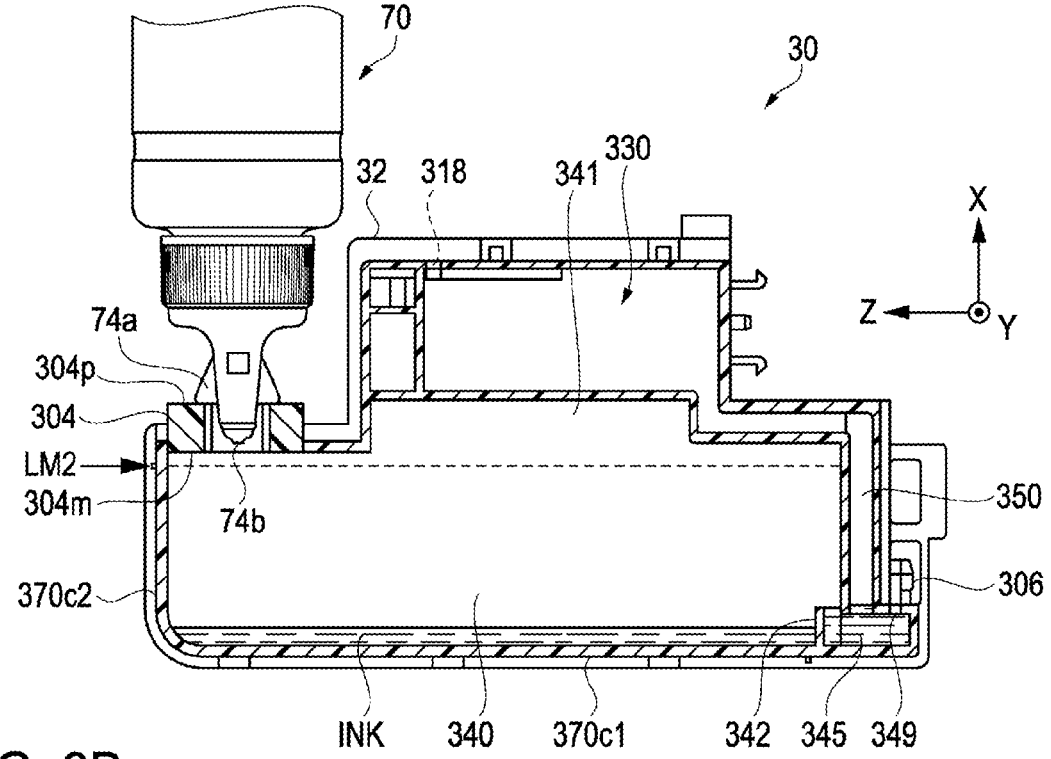
FIGS. 9A and 9B illustrate how an ink tank is filled with an ink supplied from an ink bottle.
Figure 9B:
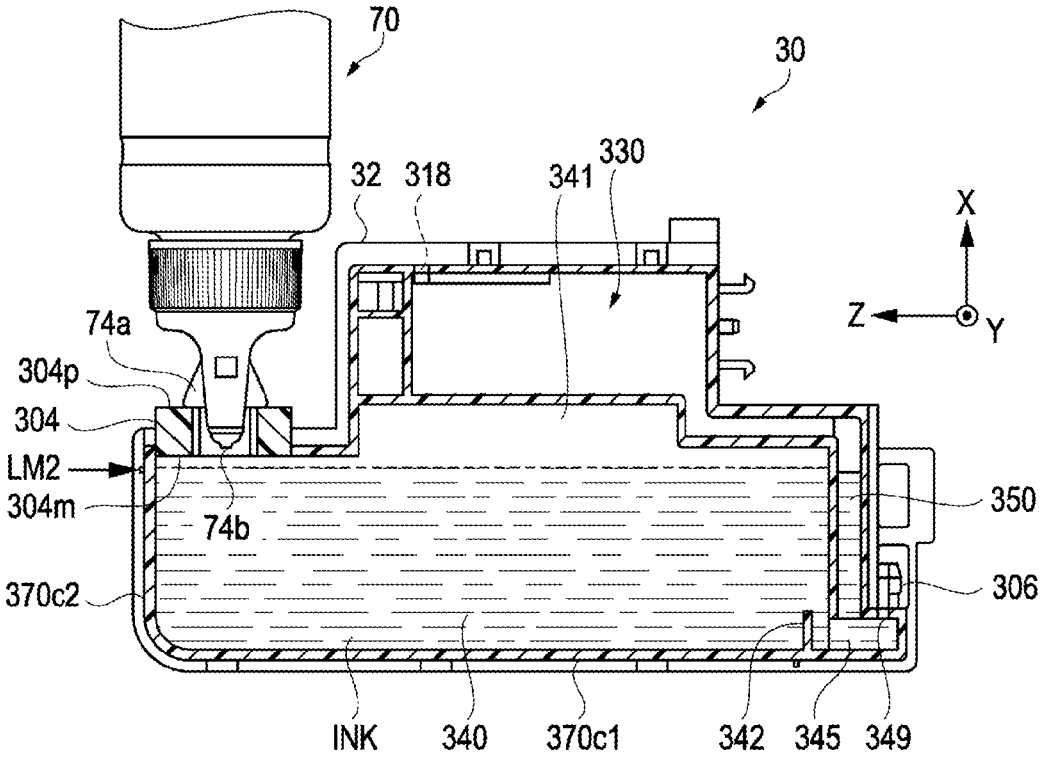

FIG. 9A illustrates a state in the middle of ink filling by use of the ink bottle 70. FIG. 9B illustrates the state where the liquid level of the ink in the liquid-containing chamber 340 has reached the upper limit line LM2 after ink filling by use of the ink bottle 70.

As illustrated in FIG. 9A, while the ink is being supplied from the ink bottle 70 to fill the ink tank 30, the upper end portion 304*p* of the liquid inlet 304 is in contact with one side (one surface) of each protrusion (positioning member) 74*a* of the ink bottle 70. Accordingly, the ink filling port 74*b* of the ink bottle 70 is positioned with respect to the ink tank 30.

In the embodiment, the two protrusions 74*a* are disposed to form an angle of 180° with respect to each other in plan view, or arranged at equal intervals in the circumferential direction of the ink guide portion 74*e*. Consequently, the reaction force that one of the protrusions 74*a* of the ink bottle 70 receives by contacting the upper end portion 304*p* of the liquid inlet 304 is well balanced with the reaction force that the other protrusion 74*a* receives. Thus, the ink bottle 70 maintains the position stably during ink-filling.

As illustrated in FIG. 9B, even when the liquid level of the ink in the liquid-containing chamber 340 has reached the upper limit line LM2 after ink filling by use of the ink bottle 70, the ink filling port 74*b* is not in contact with the surface of the liquid. If, during ink filling, the ink filling port 74*b* contacts the liquid surface of the ink in the liquid-containing chamber 340 or is soaked in the ink in the liquid-containing chamber 340, the air in the ink bottle 70 is injected into the ink in the liquid-containing chamber 340 and causes bubbles to be formed. If the bubbles burst, part of the ink forming the bubbles will scatter around and stain the ink tank 30 or the ink bottle 70. According to the embodiment, such a situation can be prevented. In addition, even when the liquid level of the ink in the liquid-containing chamber 340 has reached the upper limit line LM2, the ink filling port 74*b* and the vicinity thereof can be prevented from being stained with the ink.

B. Modifications

Components described in the embodiment other than the components described in independent claims are additional ones, and thus can be omitted as appropriate. In addition, the invention is not limited to the embodiment described above, and can be embodied in various modes within a scope not departing from the gist of the invention. The following modifications are conceivable, for example.

B-1. First Modification

In the embodiment, the two protrusions 74*a* are disposed to form an angle of 180° with respect to each other in plan view. It is, however, only required that the protrusions 74*a* be arranged at equal intervals in the circumferential direction of the ink guide portion 74*e*, or be disposed in such a manner that angles each formed by a pair of adjacent protrusions 74*a* are the same. For example, in the case where three protrusions 74*a* are provided, the angles each formed by a pair of adjacent protrusions 74*a* are 120°.

B-2. Second Modification

In the embodiment, the first label 72*a* and the second label 72*b* are affixed to the outer wall of the body unit 72 of the ink bottle 70. In addition to this, a transparent film may be affixed in such a manner as to cover the first label 72*a* and the second label 72*b*. This can protect the first label 72*a* and the second label 72*b*.

What is claimed is:

1. A liquid fill container used to fill a liquid reservoir with a liquid for printing, the liquid reservoir supplying the liquid to a liquid ejecting apparatus, the liquid fill container comprising:

a containing unit that contains the fill liquid; and a filling port that is inserted into an inlet of the liquid reservoir and that allows the liquid contained in the containing unit to flow therethrough to fill the liquid reservoir, a positioning member positioned between the filling port and the containing unit that is configured to maintain a position of the filling port and a position of the liquid reservoir with respect to each other in the direction in which the filling port is inserted into the liquid reservoir during liquid filling of the liquid reservoir;

wherein a label indicating ID information used for filling the liquid reservoir with the liquid is affixed to the liquid fill container, and wherein a surface of the label is liquid-repellent.

2. The liquid fill container of claim 1, wherein the fill liquid comprises ink.

3. The liquid fill container of claim 2, wherein the surface of the label is ink-repellent.

4. The liquid fill container of claim 1, wherein the label comprises a paper.

5. The liquid fill container of claim 4, wherein the label comprises a coating over the paper.

6. A liquid fill container used to fill a liquid reservoir with a liquid for printing, the liquid reservoir supplying the liquid to a liquid ejecting apparatus, the liquid fill container comprising:

a bottom portion;

a containing unit that contains the fill liquid; and a filling port that is inserted into an inlet of the liquid reservoir and that allows the liquid contained in the containing unit to flow therethrough to fill the liquid reservoir, wherein a first label and a second label different from the first label are affixed to the liquid fill container, and wherein in a state where the liquid fill container is placed on a horizontal surface with the bottom portion contacting the horizontal surface, the first label and the second label are affixed to the liquid fill container in such a manner that an upper end portion, in the vertical direction, of the second label overlaps a lower end portion, in the vertical direction, of the first label.

7. The liquid fill container of claim 6, wherein the fill liquid comprises ink.

8. The liquid fill container of claim 6, wherein a surface of the second label is liquid repellent.

9. The liquid fill container of claim 8, wherein the surface of the second label is ink-repellent.

10. The liquid fill container of claim 6, wherein the second label comprises a paper.

11. The liquid fill container of claim 10, wherein the second label comprises a coating over the paper.

12. The liquid fill container of claim 6, wherein the first label has an adhesive surface adhering the first label to the containing unit.

13. The liquid fill container of claim 6, wherein an upper end portion, in the vertical direction, of the first label is below the filling port.

* * * * *